US005900560A

United States Patent [19]

Pinnow et al.

[11] Patent Number: 5,900,560

[45] **Date of Patent: * May 4, 1999**

[54] CORROSION RESISTANT, HIGH VANADIUM, POWDER METALLURGY TOOL STEEL ARTICLES WITH IMPROVED METAL TO METAL WEAR RESISTANCE AND METHOD FOR PRODUCING THE SAME

[75] Inventors: Kenneth E. Pinnow, Pittsburgh; William Stasko, West Homestead; John Hauser, Freedom, all of Pa.

[73] Assignee: Crucible Materials Corporation, Syracuse, N.Y.

[ * ] Notice: This patent is subject to a terminal disclaimer.

[21] Appl. No.: 09/124,708

[22] Filed: Jul. 29, 1998

Related U.S. Application Data

[63] Continuation-in-part of application No. 08/951,629, Oct. 16, 1997, which is a continuation-in-part of application No. 08/554,376, Nov. 8, 1995, Pat. No. 5,679,908.

[51] Int. Cl.[6] ..... C22C 33/00

[52] U.S. Cl. ..... 75/246; 75/238; 75/239; 75/240; 75/243; 75/244; 419/14; 419/28; 419/29; 419/49

[58] Field of Search ..... 75/238, 239, 240, 75/243, 246, 244; 419/14, 28, 29, 49

[56] References Cited

U.S. PATENT DOCUMENTS

| | | |
|---|---|---|
| 2,199,096 | 4/1940 | Berglund . |
| 2,355,726 | 8/1944 | Harder et al. . |
| 2,575,218 | 6/1951 | Giles . |
| 2,707,132 | 5/1955 | Giles . |
| 4,121,930 | 10/1978 | Yakawa et al. . |
| 4,140,527 | 2/1979 | Kawai et al. . |
| 4,249,945 | 2/1981 | Haswell et al. . |
| 4,765,836 | 8/1988 | Hauser et al. . |
| 4,863,515 | 9/1989 | Roberts et al. . |
| 4,936,911 | 6/1990 | Roberts et al. . |
| 5,238,482 | 8/1993 | Stasko et al. . |
| 5,522,914 | 6/1996 | Stasko et al. . |

FOREIGN PATENT DOCUMENTS

| | | |
|---|---|---|
| 187929 | 2/1956 | Australia . |
| 0 341 643 A1 | 5/1989 | European Pat. Off. . |
| 0 348 380 B1 | 6/1989 | European Pat. Off. . |
| 35 08 982 A1 | 9/1986 | Germany . |
| 39 01 470 C1 | 1/1989 | Germany . |
| 59-64748 | 4/1984 | Japan . |
| 62-10293 | 3/1987 | Japan . |
| WO 88/07093 | 9/1988 | WIPO . |

*Primary Examiner*—Ngoclan Mai
*Attorney, Agent, or Firm*—Finnegan, Henderson, Farabow, Garrett & Dunner, L.L.P.

[57] ABSTRACT

A high vanadium, powder metallurgy cold work tool steel article and method for production. The nickel, chromium, vanadium, and carbon plus nitrogen contents of the steel are controlled during production to achieve a desired combination of corrosion resistance, metal to metal wear resistance, and hardenability.

16 Claims, 3 Drawing Sheets

CORROSION RESISTANT, HIGH VANADIUM, POWDER METALLURGY TOOL STEEL ARTICLES WITH IMPROVED METAL TO METAL WEAR RESISTANCE AND METHOD FOR PRODUCING THE SAME

CROSS REFERENCE TO RELATED APPLICATIONS

This application is a continuation-in-part of U.S. patent application Ser. No. 08/951,629, filed Oct. 16, 1997, which was a continuation-in-part of U.S. patent application Ser. No. 08/554,376, filed Nov. 8, 1995, U.S. Pat. No. 5,679,908.

BACKGROUND OF THE INVENTION

1. Field of the Invention

The invention relates to highly wear and corrosion resistant, powder metallurgy tool steel articles and to a method for their production by compaction of nitrogen atomized, prealloyed high vanadium powder particles. The articles are characterized by exceptionally high metal to metal wear resistance, which in combination with their good abrasive wear resistance and corrosion resistance, makes them particularly useful in machinery used for processing reinforced plastics and other abrasive or corrosive materials.

2. Background of the Invention

Basically, there are three types of wear that can occur, often in combination, in the barrels, screws, valves, molds, and other components used in processing reinforced plastics and other aggressive materials. They include metal to metal wear caused in areas where the metal components come into direct contact during operation, abrasive wear caused by continued contact at high pressures of the components with hard particles in the process media, and corrosive wear caused by acids or other corrodents either originally present or released from the process media at elevated temperatures of operation. To perform satisfactorily, the articles used in processing these materials must be highly resistant to these forms of wear. In addition, they must possess sufficient mechanical strength and toughness to withstand the stresses imposed during operation. Further, they must be readily machined, heat treated, and ground to facilitate the manufacture of parts with the required shape and dimensions.

A wide range of materials have been evaluated for the construction of the components employed in the processing of reinforced plastics and other abrasive or corrosive materials. They include chromium plated alloy steels, conventional high chromium martensitic stainless steels such as AISI Types 440B and 440C stainless steels, and a number of high chromium martensitic stainless steels produced by powder metallurgical methods. The compositions of this latter group of materials are broadly similar to those of the conventional high chromium martensitic stainless steels, except that greater than customary amounts of vanadium and carbon are added to improve their wear resistance. The high chromium, high vanadium, powder metallurgy stainless steels, such as CPM 440V disclosed on page 781 in Volume 1 of the 10th Edition of the ASM Metals Handbook and MPL-1 disclosed in recent publications, clearly outperform conventional steels in plastic processing, but none of these materials fully meet all the needs of the newer plastic processing machinery which cannot accommodate large wear related changes in the geometry of the operating parts and where contamination of the process media by wear debris must be minimized. Of all the required properties, the metal to metal wear resistance of the high chromium martensitic stainless steels made either by conventional or powder metallurgy methods is remarkably low.

SUMMARY OF THE INVENTION

It has been discovered in this regard, that the metal to metal wear resistance of the high chromium, high vanadium, powder metallurgical stainless steels is markedly affected by their chromium content and that by lowering their chromium content and closely balancing their overall composition, a significantly improved and unique combination of metal to metal, abrasive, and corrosive wear resistance can be achieved in these materials. In addition, it has been discovered that for some applications the corrosion resistance of these materials can be notably improved by increasing the nitrogen content of the prealloyed powders from which they are made. In addition, it has also been discovered that the hardenability of these materials can be significantly improved by increasing their nickel content. Further, it has been discovered that to obtain the desired combinations of wear and corrosion resistance along with good strength, toughness, and grindability in the articles of the invention, it is necessary to closely control the atomization and compaction conditions of the prealloyed powders from which these improved articles are produced.

It is accordingly a primary object of the invention to provide corrosion resistant, high vanadium, powder metallurgy tool steel articles with notably improved metal to metal wear resistance. This is achieved by closely controlling chromium content, which generally improves corrosion resistance, but which unexpectedly has been found to have a highly negative effect on metal to metal wear resistance, and by balancing the overall composition of the articles so as to obtain the desired degree of hardness and wear resistance without reducing corrosion resistance.

An additional objective of the invention is to provide corrosion resistant, high vanadium, powder metallurgy tool steel articles with notably improved metal to metal wear resistance in which greater than residual amounts of nitrogen are incorporated to improve corrosion resistance without reducing wear resistance.

An additional objective of the invention is to provide corrosion resistant, high vanadium, powder metallurgy tool steel articles with notably improved metal to metal wear resistance in which greater than residual amounts of nickel are incorporated to improve their hardenability.

A still further objective of the invention is to provide a method for producing the corrosion resistant, high vanadium, tool steel articles of the invention with good strength, toughness, and grindability from nitrogen atomized, prealloyed powder particles. This is largely achieved by closely controlling the size of chromium-rich and vanadium-rich carbides or carbonitrides formed during the atomization and hot isostatic compaction of the nitrogen atomized powders from which the articles of the invention are made.

These and other objects of the invention are achieved with powder metallurgical articles in accordance with the following processing and compositions.

In accordance with the method of the invention, the article thereof is produced by nitrogen gas atomizing a molten tool steel alloy at a temperature of 2800 to 3000° F., preferably 2840 to 2880° F., rapidly cooling the resulting powder to ambient temperature, screening the powder to about −16 mesh (U.S. Standard), hot isostatically compacting the powder at a temperature of 2000 to 2100° F. at a pressure of 13 to 16 ksi, preferably 15 ksi, whereby the resulting articles after hot working, annealing and hardening to 58HRC, have a volume fraction of primary $M_7C_3$ and MC carbides of 16 to 36% in which the volume of MC carbides is at least one-third of the primary carbide volume and where the maximum sizes of the primary carbides do not exceed about six microns in their largest dimension and wherein a metal to metal wear resistance of at least $10\times10^{10}$ psi, as defined herein, is achieved.

To obtain the hardness and carbide or carbonitride volumes needed to achieve the desired combination of wear and corrosion resistance, the carbon and nitrogen in the articles of the invention must be balanced with the chromium, molybdenum, and vanadium contents of the articles according to the following formulas:

$$(\%C+6/7\%N)_{minimum}=0.40+0.099(\%Cr-11.0)+0.063(\%Mo)+0.177(\%V);$$

| Element | Broad Range | Preferred Range for Highest Wear Resistance | Most Preferred Range for Highest Wear Resistance | Preferred Range for Highest Corrosion Resistance | Most Preferred Range for Highest Corrosion Resistance |
|---|---|---|---|---|---|
| Carbon* | 1.47–3.77 | 1.83–3.77 | 2.54–3.77 | 1.60–3.62 | 2.31–3.62 |
| Manganese | 0.2–2.0 | 0.2–1.0 | 0.2–1.0 | 0.2–1.0 | 0.2–1.0 |
| Phosphorus | 0.10 max | 0.05 max | 0.05 max | 0.05 max | 0.05 max |
| Sulfur | 0.10 max | 0.03 max | 0.03 max | 0.03 max | 0.03 max |
| Silicon | 2.0 max | 0.2–1.0 | 0.2–1.0 | 0.2–1.0 | 0.2–1.0 |
| Chromium | 11.5–14.5 | 12.5–14.5 | 12.5–14.5 | 12.5–14.5 | 12.5–14.5 |
| Molybdenum | 3.0 max | 0.5–3.0 | 0.5–3.0 | 0.5–3.0 | 0.5–3.0 |
| Vanadium | 8.0–15.0 | 8.0–15.0 | 12.0–15.0 | 8.0–15.0 | 12.0–15.0 |
| Nitrogen* | 0.03–0.46 | 0.03–0.19 | 0.03–0.19 | 0.20–0.46 | 0.20–0.46 |
| Iron** | Balance | Balance | Balance | Balance | Balance |

*$(\%\ C + 6/7\%\ N)_{minimum} = 0.40 + 0.099(\%\ Cr - 11.0) + 0.063(\%\ Mo) + 0.1\ 77(\%\ V)$; $(\%\ C + 6/7\%\ N)_{maximum} = 0.60 + 0.099(\%\ Cr - 11.0) + 0.063(\%\ Mo) + 0.177(\%\ V)$
**Includes incidental elements and impurities characteristic of steel making practice.

In accordance with the present invention, the above-recited composition ranges are modified by alloying additions of nickel within the ranges of 0.30 to 1.80%, 0.30 to 1.00%, and 0.30 to 0.60%.

It is important in regard to the invention to balance the amount of carbon, nitrogen, and other austenite forming elements in the articles with respect to the ferrite forming elements, such as silicon, chromium, vanadium, and molybdenum, to avoid the formation of ferrite in the microstructure. Ferrite reduces the hot workability of the articles of the invention and lowers their attainable hardness. It is also important to control the amounts of carbon, nitrogen, and other alloying elements in the articles of the invention to avoid forming unduly large amounts of retained austenite during heat treatment as well as to obtain the improved combination of metal to metal, abrasive, and corrosive wear resistance. Specifically, carbon is required within the indicated ranges for controlling ferrite, forming hard wear resistant carbides or carbonitrides with vanadium, chromium, and molybdenum, and for increasing the hardness of the martensite in the matrix. Amounts of carbon greater than the indicated limit reduce corrosion resistance significantly.

The alloying effects of nitrogen in the articles of the invention are somewhat similar to those of carbon. Nitrogen increases the hardness of martensite and can form hard nitrides and carbonitrides with carbon, chromium, molybdenum, and vanadium that can increase wear resistance. However, nitrogen is not as effective for this purpose as carbon in high vanadium steels because the hardnesses of vanadium nitride or carbonitride are significantly less than that of vanadium carbide. In contrast to carbon, nitrogen is useful for improving the corrosion resistance of the articles of the invention when dissolved in the matrix. For this reason, nitrogen in an amount up to about 0.46% can be used to improve the corrosion resistance of the articles of the invention. However, for highest wear resistance, nitrogen is best limited to about 0.19% or to the residual amounts introduced during nitrogen atomization of the powders from which the articles of the invention are made.

$$(\%C+6/7\%N)_{maximum}=0.60+0.099(\%Cr-11.0)+0.063(\%Mo)+0.177(\%V)$$

It is essential in accordance with the invention to control the amounts of chromium, molybdenum, and vanadium within the above indicated ranges to obtain the desired combination of wear and corrosion resistance, along with adequate hardenability, hardness, toughness, machinability, and grindability.

Vanadium is very important for increasing metal to metal and abrasive wear resistance through the formation of MC-type vanadium-rich carbides or carbonitrides in amounts greater than previously obtainable in corrosion and wear resistant powder metallurgy tool steel articles.

Manganese is present to improve hardenability and is useful for controlling the negative effects of sulfur on hot workability through the formation of manganese sulfide. It is also useful for increasing the liquid solubility of nitrogen in the melting and atomization of the high nitrogen powder metallurgy articles of the invention. However, excessive amounts of manganese can lead to the formation of unduly large amounts of retained austenite during heat treatment and increase the difficulty of annealing the articles of the invention to the low hardnesses needed for good machinability.

Silicon is used for deoxidation purposes during the melting of the prealloyed materials from which the nitrogen atomized powders used in the articles of the invention are made. It is also useful for improving the tempering resistance of the articles of the invention. However, excessive amounts of silicon decrease toughness and unduly increase the amount of carbon or nitrogen needed to prevent the formation of ferrite in the microstructure of the powder metallurgical articles of the invention.

Nickel in amounts from about 0.30% to 1.80% has been found to increase the hardenability of the articles of the invention to a much greater extent than expected from its reported effects on the hardenability of low alloy steels. Similar to manganese, excessive amounts of nickel can introduce unduly large amounts of retained austenite during heat treatment and increase the difficulty of annealing the articles of the invention to the low hardnesses needed for some machining and bar straightening operations. Therefore, the nickel contents of the articles of the invention are best kept to residual amounts below about 0.30% when low annealed hardnesses are necessary or when hardening small parts where hardenability is normally not an issue. However, for applications where low annealed hardnesses are not essential or where greater hardenability is desired such as for articles having large cross sections or when the articles cannot be rapidly cooled from the austenitizing temperature, such as in some vacuum hardening operations, it is advantageous to increase their nickel content to between about 0.30 to 1.00% or 0.30 to 0.60%.

Chromium is very important for increasing the corrosion resistance, hardenability, and tempering resistance of the articles of the invention. However, it has been found to have a highly detrimental effect on the metal to metal wear resistance of high vanadium corrosion and wear resistant tool steels and for this reason must be limited in the articles of the invention to the minimums necessary for good corrosion resistance.

Molybdenum, like chromium, is very useful for increasing the corrosion resistance, hardenability, and tempering resistance of the articles of the invention. However, excessive amounts reduce hot workability. As is well known, tungsten may be substituted for a portion of the molybdenum in a 2:1 ratio in an amount for example up to about 1%.

Sulfur is useful for improving machinability through the formation of manganese sulfide. However, it can significantly reduce hot workability and corrosion resistance. In applications where corrosion resistance is paramount, it needs to be kept to a maximum of 0.03% or lower.

When desirable, boron in amounts up to about 0.005% can be added to improve the hot workability of the articles of the invention.

The alloys used to produce the nitrogen atomized, high vanadium, prealloyed powders used in making the articles of the invention may be melted by a variety of methods, but most preferably are melted by air, vacuum, or pressurized induction melting techniques. However, the temperatures used in melting and atomizing the alloys, in particular for those containing more than about 12% vanadium, and the temperatures used in hot isostatically compacting the powders must be closely controlled to obtain the fine carbide or carbonitride sizes necessary to achieve good toughness and grindability while maintaining greater amounts of these carbides or carbonitrides to achieve the desired levels of metal to metal and abrasive wear resistance.

DETAILED DESCRIPTION OF THE PREFERRED EMBODIMENTS

TABLE I

Figure 1:
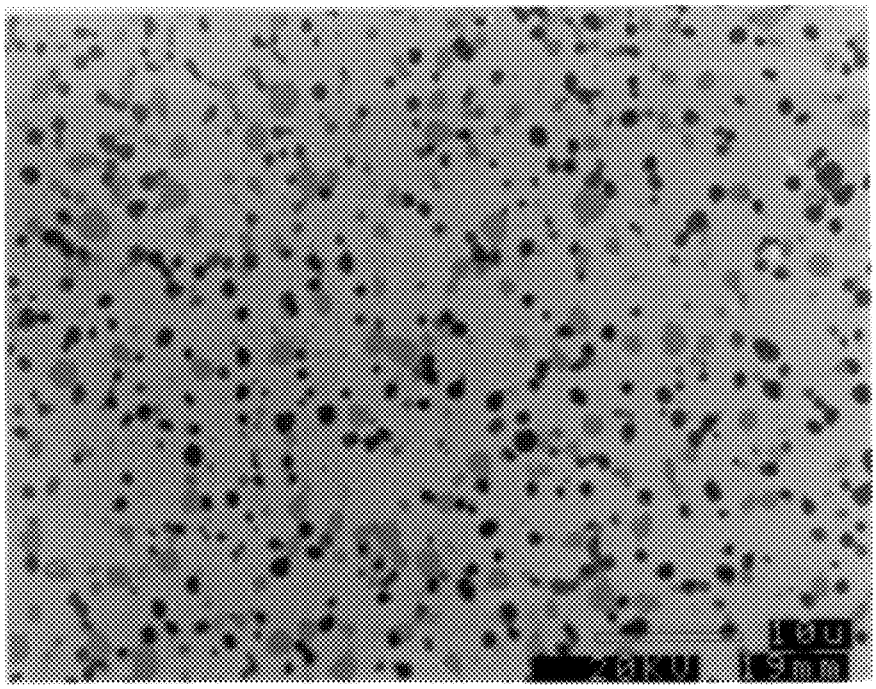
FIG. 1 is an electron photomicrograph showing the size and distribution of the primary carbides in a high vanadium PM tool steel article of the invention containing 13.57% chromium and 8.90% vanadium (Bar 95-6).

| | | | Chemical Composition of Experimental Materials | | | | | | | | | | | |
|---|---|---|---|---|---|---|---|---|---|---|---|---|---|---|
| Bar No. | Heat No. | Atomization Temp ° F. | C | Mn | P | S | Si | Ni | Cr | V | Mo | N | O | Comments |
| 89-163 | 515-656 | — | 1.78 | 1.04 | — | — | 0.90 | — | 12.63 | 6.33 | 0.21 | 0.09 | — | 0.20% C added |
| 95-6 | L517 | 2880 | 2.25 | 0.49 | 0.017 | 0.005 | 0.58 | 0.01 | 13.57 | 8.90 | 1.03 | 0.098 | 0.0105 | — |
| 97-199 | P73074-2 | — | 2.31 | 0.50 | — | — | 0.50 | 0.07 | 14.02 | 8.98 | 1.03 | 0.07 | — | — |
| 95-21 | P69231-2 | — | 2.16 | 0.51 | 0.016 | 0.017 | 0.46 | 0.11 | 13.25 | 8.53 | 1.04 | 0.079 | 0.0166 | — |
| 95-5 | P69230-1 | — | 2.14 | 0.50 | 0.017 | 0.016 | 0.47 | 0.13 | 13.30 | 8.55 | 1.04 | 0.093 | 0.0220 | — |
| 97-460 | L957 | — | 2.17 | 0.63 | — | — | 0.55 | 0.15 | 13.78 | 8.48 | 1.03 | 0.095 | — | — |
| 97-464 | L955 | — | 2.28 | 0.82 | — | — | 0.78 | 0.25 | 13.93 | 8.31 | 1.04 | 0.078 | — | — |
| 97-467 | L956 | — | 2.25 | 0.84 | — | — | 0.81 | 0.38 | 13.78 | 8.50 | 1.04 | 0.09 | — | — |
| 94-332 | L922 | — | 2.40 | 0.75 | — | — | 0.83 | 0.44 | 14.02 | 9.35 | 1.04 | 0.086 | — | — |
| 91-17 | P77324-2 | — | 2.15 | 0.40 | 0.024 | 0.015 | 0.47 | 0.52 | 12.32 | 8.80 | 1.02 | 0.07 | 0.0180 | — |
| 90-60 | 518-011 | — | 2.30 | 0.53 | 0.017 | 0.001 | 0.52 | 0.88 | 11.77 | 9.27 | 1.05 | 0.047 | 0.0050 | — |
| 98-83 | L1015 | — | 2.31 | 0.48 | 0.011 | 0.023 | 0.46 | 0.97 | 14.26 | 9.15 | 1.02 | 0.11 | — | — |
| 95-24 | L526 | 2860 | 1.91 | 0.33 | 0.019 | 0.004 | 0.50 | — | 13.40 | 8.94 | 0.99 | 0.32 | 0.0136 | — |
| 95-240 | L526 + C | — | 2.01 | — | — | — | — | — | — | — | — | — | — | 0.10% C added |
| 95-241 | L526 + C | — | 2.10 | — | — | — | — | — | — | — | — | — | — | 0.20% C added |
| 95-342 | L612 | — | 1.95 | 0.56 | — | 0.006 | 0.58 | — | 13.33 | 8.86 | 1.06 | 0.458 | — | — |
| 95-341 | L612 + C | — | 2.10 | — | — | — | — | — | — | — | — | — | — | 0.15% C added |
| 95-7 | L520 | 2860 | 2.84 | 0.51 | 0.017 | 0.004 | 0.58 | — | 13.43 | 11.96 | 1.06 | 0.104 | 0.0135 | — |
| 95-8 | L521 | 2840 | 2.78 | 0.47 | 0.014 | 0.004 | 0.62 | — | 13.53 | 11.96 | 2.72 | 0.093 | 0.0137 | — |
| 95-207 | L521 + C | — | 2.94 | — | — | — | — | — | — | — | — | — | — | 0.20% C added |
| 95-23 | L525 | 2860 | 3.24 | 0.47 | 0.020 | 0.004 | 0.53 | — | 13.31 | 14.47 | 1.08 | 0.12 | 0.026 | — |

To demonstrate the principles of the invention, a series of alloys were produced by induction melting and then nitrogen atomizing. The chemical compositions, in percent by weight, and the atomizing temperatures for these alloys are given in Table I above. Also several commercial ingot cast or powder metallurgy wear or wear and corrosion resistant alloys were obtained and tested for comparison. The chemical compositions of these commercial alloys are given in Table II.

TABLE II

Chemical Composition of Materials Tested for Comparison

| Material | Bar No. | Heat | C | Mn | P | S | Si | Ni | Cr | V | Mo | W | N | O | Comments |
|---|---|---|---|---|---|---|---|---|---|---|---|---|---|---|---|
| A - Powder Metallurgy Materials | | | | | | | | | | | | | | | |
| CPM10V | 85-34 | P67018-1 | 2.51 | 0.51 | 0.021 | 0.085 | 0.89 | 0.06 | 5.25 | 9.63 | 1.25 | 0.01 | 0.038 | 0.014 | — |
| CPM10V | 93-16 | P66210-2 | 2.45 | 0.50 | 0.022 | 0.073 | 0.89 | — | 5.31 | 9.74 | 1.28 | — | 0.055 | 0.017 | — |
| K190 | 90-136 | — | 2.28 | 0.30 | 0.019 | 0.018 | 0.36 | 0.12 | 12.50 | 4.60 | 1.11 | 0.17 | 0.067 | — | — |
| Elmax | 90-99 | — | 1.70 | 0.30 | — | 0.011 | 0.31 | 0.19 | 17.90 | 3.37 | 1.09 | 0.08 | 0.10 | — | — |
| CPM440V | 93-48 | P66899-2 | 2.21 | 0.39 | 0.018 | 0.017 | 0.42 | 0.10 | 16.71 | 5.26 | 0.40 | — | 0.059 | — | — |
| CPM440V | 87-152 | P70144-1 | 2.11 | 0.41 | 0.023 | 0.025 | 0.43 | 0.18 | 16.89 | 5.34 | 0.42 | — | 0.050 | — | — |
| CPM440V | 93-73 | P77797-1 | 2.14 | 0.40 | 0.022 | 0.019 | 0.38 | — | 16.98 | 5.39 | 0.40 | 0.045 | 0.072 | — | — |
| CPM440 VM (6V) | 91/16 | P77326-2 | 1.89 | 0.44 | 0.026 | 0.015 | 0.44 | 0.60 | 17.32 | 6.34 | 1.09 | 0.03 | 0.06 | — | — |
| CPM440 VM(9V) | 91-90 | L8 | 2.54 | 0.44 | 0.017 | 0.006 | 0.23 | 0.53 | 17.75 | 8.80 | 1.30 | — | 0.16 | — | — |
| M390 | 90-100 | — | 1.89 | 0.26 | — | 0.017 | 0.21 | 0.16 | 19.00 | 4.23 | 1.02 | 0.51 | 0.11 | — | — |
| | 90-137 | | 1.87 | 0.27 | 0.019 | 0.020 | 0.33 | 0.14 | 18.86 | 4.34 | 0.97 | 0.49 | 0.15 | 0.0260 | — |
| MPL-1 | 91-12 | P63231 | 3.74 | 0.48 | 0.019 | 0.012 | 0.48 | 0.12 | 24.21 | 9.02 | 3.01 | — | 0.079 | 0.019 | — |
| B - Conventional Ingot Cast Materials | | | | | | | | | | | | | | | |
| D-7 | 75-36 | — | 2.35 | 0.34 | 0.020 | 0.005 | 0.32 | 0.31 | 12.75 | 4.43 | 1.18 | 0.26 | 0.037 | 0.0034 | — |
| 440B | — | — | 0.89 | 0.37 | 0.017 | 0.017 | 0.35 | 0.17 | 18.5 | 0.10 | 0.84 | 0.02 | 0.04 | 0.027 | — |
| 440C | — | A18017 | 1.03 | 0.47 | 0.024 | 0.002 | 0.44 | — | 16.84 | — | 0.53 | — | 0.04 | — | — |

The laboratory alloys in Table I were processed by (1) screening the prealloyed powders to −16 mesh size (U.S. standard), (2) loading the screened powder into five-inch diameter by six-inch high mild steel containers, (3) vacuum outgassing the containers at 500° F., (4) sealing the containers, (5) heating the containers to 2065° F. for four hours in a high pressure autoceave operating at about 15 ksi, and (6) then slowly cooling them to room temperature. In some instances, small amounts of carbon (graphite) were mixed with the powders before loading them into the containers to systematically increase their carbon content. All the compacts were readily hot forged to bars using a reheating temperature of 2050° F. Test specimens were machined from the bars after they had been annealed using a conventional tool steel annealing cycle, which involves heating at 1650° F. for 2 hours, slowly cooling to 1200° F. at a rate not to exceed 25° F. per hour, and then air cooling to ambient temperature.

Several examinations and tests were conducted to demonstrate the advantages of the PM tool steel articles of the invention and the critically of their compositions and methods of production. Specifically, tests and examinations were made to evaluate their (1) microstructure, (2) hardness in the heat treated condition, (3) hardenability, (4) Charpy C-notch impact strength, (5) performance in a crossed-cylinder wear test as a measure of metal to metal wear resistance, (6) performance in a pin abrasion test as a measure of abrasive wear resistance, and (7) corrosion resistance in modified aqua regia and boiling acetic acid tests as a measure of corrosion resistance in corrosive plastics and other aggressive materials.

Microstructure

Figure 2:
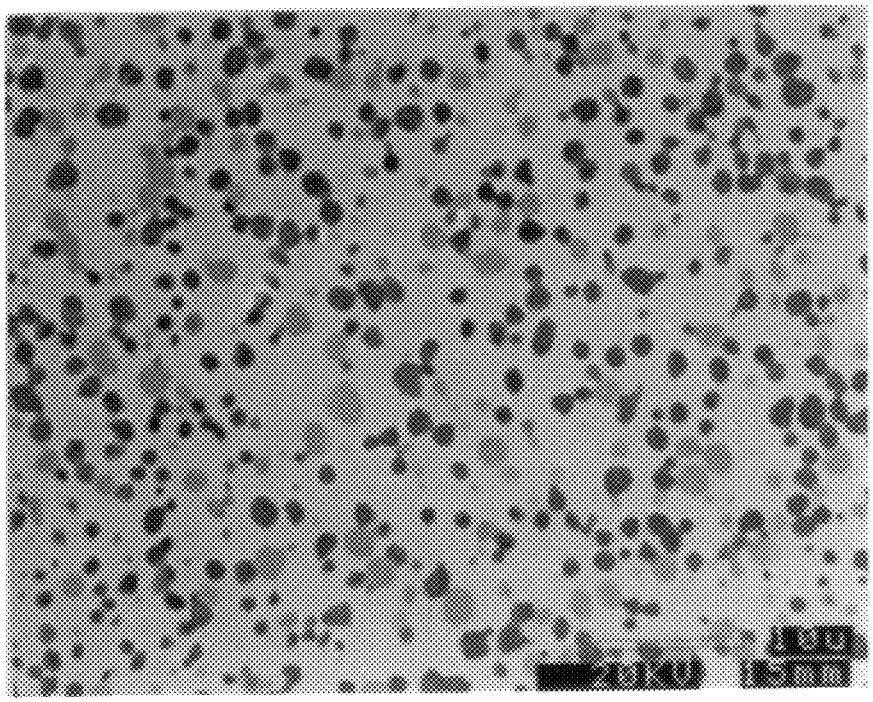
FIG. 2 is an electron photomicrograph showing the size and distribution of the primary carbides in a high vanadium PM tool steel article of the invention containing 13.31% chromium and 14.47% vanadium (Bar 95-23).

The characteristics of the primary chromium-rich $M_7C_3$-type and vanadium-rich MC-type carbides present in the PM articles of the invention are shown in the electron photomicrographs given in FIGS. 1 and 2. The chromium-rich carbides are gray, while the vanadium-rich carbides are colored black in these photomicrographs. Except for the indicated differences in the amounts of these carbides, it is evident that the carbides in heat treated samples from Bar 95-6, which contains 13.57% chromium and 8.90% vanadium, and Bar 92-23, which contains 13.31% chromium and 14.47% vanadium, are well distributed and similar in size and shape. The maximum sizes of the chromiumrich carbides tend to be larger than those of the vanadium-rich carbides, but in general, the sizes of almost all the carbides do not exceed about 6 microns in their longest dimension. The small sizes of the primary carbides are consistent with the teaching of U.S. Pat. No. 5,238,482, which indicates that the sizes of the vanadium-rich MC-type carbides in high vanadium PM cold work tool steels can be controlled by use of higher than normal atomization temperatures and that small carbide sizes are desirable for achieving good toughness and grindability. However, based on the atomization temperatures for the powders from which Bars 95-6 and 95-23 were made (2880 and 2860° F., respectively), it is clear that the composition of these bars, in particular their high chromium content, permits use of atomization temperatures lower than the minimum of 2910° F. required for controlling the size of the MC-type carbides in the lower chromium high vanadium tool steel particles disclosed in this patent. The ability to use lower atomization temperatures facilitates the production and lowers the cost of producing the powders from which the articles of the invention are made.

To further characterize the microstructure of the powder metallurgical articles of the invention, the volume fraction of the primary chromium-rich $M_7C_3$ carbides and the vanadium-rich MC carbides present in heat treated samples of four articles within the scope of the invention (Bars 95-6, 95-7, 95-23, and 95-342) were determined by image analysis and compared to those in a high vanadium, high chromium, powder metallurgy wear and corrosion resistant material of current design (Bar 93-48). The results of the measurements, which are given in Table III, show that the volume fraction of the vanadium-rich MC carbides in the articles of the invention increases with vanadium content and that the volume fraction of the MC carbides generally exceeds at least one third of the total volume of primary carbide present in these articles when they are austenitized at 2050° F. and then tempered at 500° F. In contrast, the commercial PM material after the same heat treatment contains a much smaller proportion of vanadium-rich MC carbides. Compare, for example, the difference in the carbide contents of Bar 93-48 with those of Bar 95-6, which is within the scope of the invention and which contains about the same total volume of primary carbide.

TABLE III

Primary Carbide Volume of Experimental and Commercial Materials*

| Material | Bar No. | Heat No. | C | Cr | V | Mo | N | Carbide Content-Volume Percent: Chromium-Rich $M_7C_3$ | Vanadium-Rich MC | Total Primary Carbide |
|---|---|---|---|---|---|---|---|---|---|---|
| PM420V (9V) | 95-6 | L517 | 2.25 | 13.57 | 8.90 | 1.03 | 0.098 | 13.5 | 9.4 | 22.9 |
| PM420V (12V) | 95-7 | L520 | 2.84 | 13.43 | 11.96 | 1.02 | 0.104 | 15.7 | 12.6 | 28.3 |
| PM420V (14.5V) | 95-23 | L525 | 3.24 | 13.31 | 14.47 | 1.06 | 0.12 | 14.6 | 17.1 | 31.7 |
| PM420VN (9V) | 95-342 | L612 | 1.95 | 13.33 | 8.86 | 1.06 | 0.458 | 14.9 | 10.0 | 24.9 |
| PM440V | 93-48 | P66899-2 | 2.21 | 16.71 | 5.26 | 0.40 | 0.059 | 21.5 | 2.1 | 23.6 |

*Heat Treatment - 2050° F./30 minutes, OQ, 500° F./2 + 2 hours.

Hardness

Hardness is an important factor affecting the strength, toughness, and wear resistance of martensitic tool steels. In general, a minimum hardness of about 58HRC is needed with cold work tool steels for them to adequately resist deformation in service. Higher hardnesses are useful for increasing wear resistance, but for corrosion resistant cold work tool steels, the compositions and heat treatments needed to achieve these higher hardnesses often result in a loss of toughness or corrosion resistance. In this regard, Table IV contains data on the carbon and nitrogen levels needed in the PM articles of the invention to achieve a minimum hardness of about 58HRC when they are austenitized between 2050 and 2150° F., oil quenched, and then tempered in the temperature range (500 to 600° F.) producing best corrosion resistance. They indicate that to achieve the desired hardness response, the carbon and nitrogen levels of these articles must be equal to or exceed the minimums indicated by the following relationship:

$$(\%C+6/7\%N)_{minimum}=0.40+0.099(\%Cr-11.0)+0.063(\%Mo)+0.177(\%V)$$

The importance of this relationship is shown by the hardness data for Bars 95-8 and 95-24, whose combined carbon and nitrogen levels are below the calculated minimums and which as a consequence do not provide the required hardness after the indicated heat treatments. To achieve a hardness of at least 58HRC with these two materials, it was necessary to increase their carbon contents. With Bar 95-8, which contains 0.093% nitrogen and which has a calculated minimum carbon content of 2.86%, increasing carbon from 2.74% to 2.94%, as with bar 95-207, provided the desired hardness. With Bar 95-24, which contains 0.32% nitrogen and which has a calculated minimum carbon content of 2.01%, increasing carbon from 1.91% to 2.01% as with Bar 95-240, and from 1.91% to 2.10% as with Bar 93-241, produced the desired hardness.

Hardenability

Hardenability is an important tool steel property that relates to the depth to which a steel can be fully hardened under a specific set of heating and cooling conditions. For a given section size of an article, it directly affects the rate of cooling needed to fully harden the article over its entire cross section; or conversely, it affects the maximum size of an article that can be fully hardened across its cross section for a given rate of cooling. To demonstrate the strong effect of nickel on the hardenability of the powder metallurgical articles of the invention, small samples of these materials, about ¾-inch by ¾-inch by ¾-inch in size, were austenitized and slowly cooled to room temperature to approximate the cooling rates encountered in the centers of slowly cooled or slack-quenched bars. This was done by heating the samples at 2100° F. for 10 minutes and then by very slowly cooling them to room temperature by rapidly placing them on a heavy section of thermal insulation and then covering them with a layer of the thermal insulation material. After the samples reached room temperature, they were tempered at 500° F. for 2+2 hours and tested for hardness.

Table V contains the results of the slow cooling (hardenability) experiments as well as the annealed and the heat treated hardnesses obtained for several different PM articles having carbon, nitrogen, chromium, vanadium, and molybdenum contents within the scope of the invention and with nickel contents ranging from 0.01 to 0.97%. When oil quenched from an austenitizing temperature of 2050° F. and then double tempered at 500° F., the hardness of all these PM articles is about the same (59–60HRC), indicating that for rapidly cooled (oil quenched) samples where hardenability is normally not a consideration, the differences in nickel content produced essentially no difference in their attainable hardness. However, for the slowly cooled samples where hardenability is an important consideration, it can be seen that nickel in amounts greater than 0.25% substantially increased their hardness, indicating that these amounts of nickel have a highly positive effect on their hardenability. Judged on the marked differences in the hardness of the slowly cooled samples from Bar 97-464 which contains 0.25% nickel (26.5HRC) and from Bar 97-457 which contains 0.38% nickel (51.5HRC), the minimum amount of nickel needed to effectively increase the hardenability of the PM articles of the invention is about 0.30%.

A similar effect of nickel on the hardenability of the PM articles of the invention can be seen by comparing their annealed hardnesses where increasing their nickel contents from 0.01 to 0.97% increased their annealed hardnesses from about 22 to 31.5HRC. As for the slowly cooled samples, the greatest effect of nickel on the hardness of the annealed samples occurs at nickel contents between 0.25 and 0.38%. Taken together, these data confirm that when low annealed hardnesses below about 26 to 27HRC are needed, the nickel content should be kept below about 0.30%. However, when low annealed hardnesses are not essential, nickel in amounts of about 0.30 to 0.60 or 0.30 to 1.00% can be beneficially used to increase the hardenability of the articles in accordance with the invention.

Impact Toughness

To evaluate the impact toughness of the PM articles of the invention, Charpy C-notch impact tests were conducted at room temperature on heat treated specimens having a notch radius of 0.5 inch. The procedure for the tests was similar to that given in ASTM Standard E23-88. Results obtained for specimens prepared from three different PM articles made within the scope of the invention and for several commercial wear or wear and corrosion resistant alloys are given in Table VI. The results show that the impact toughness of the PM articles of the invention generally decreases with increased vanadium content. They also show that the toughness of the PM articles of the invention, depending on vanadium content, is comparable to or better than that of several widely used conventional ingot cast or PM cold work tool steels, which as shown in Table VII, have much poorer metal to metal wear resistance.

TABLE IV

Heat Treatment Response of Experimental Metals

| | | | | | | | Hardness | | | | | | | | Calculated |
|---|---|---|---|---|---|---|---|---|---|---|---|---|---|---|---|
| | | | | | | | 2050° F./30 minutes, OQ | | | | 2150° F./10 minutes, OQ | | | | Minimum |
| Material | Bar No. | C | Cr | V | Mo | N | As Q | 500° F. 2 + 2 hr | 600° F. 2 + 2 hr | 750° F. 2 + 2 hr | As Q | 500° F. 2 + 2 hr | 600° F. 2 + 2 hr | 750° F. 2 + 2 hr | Carbon Content* |
| CPM 420V (9V) | 95-6 | 2.25 | 13.57 | 8.90 | 1.03 | 0.098 | 63 | 59.5 | 60 | 60.5 | 63 | 59 | 59.5 | 60.5 | 2.21 |
| CPM 420V (12V) | 95-7 | 2.84 | 13.43 | 11.96 | 1.06 | 0.104 | 63.5 | 60 | 60.5 | 61 | 63.5 | 60.5 | 60.5 | 61 | 2.74 |
| CPM 420V (12V + Mo) | 95-8 | 2.78 | 13.53 | 11.96 | 2.72 | 0.093 | — | 51 | 53 | 53 | 62.5 | 59 | 59 | 59.5 | 2.86 |
| — | 95-207 | 2.94 | — | — | — | — | 63.5 | 60 | 60 | 61 | 63.5 | 60 | 60 | 61 | — |
| CPM 420V | 95-23 | 3.24 | 13.31 | 14.74 | 1.08 | 0.12 | 64 | 60 | 61.5 | 62 | 64 | 61 | 61 | 62 | 3.16 |
| CPM 420VN | 95-24 | 1.91 | 13.40 | 8.94 | 0.099 | 0.32 | 60 | 56 | 57 | 57.5 | 61.5 | 57.5 | 57.5 | 58.5 | 2.01 |
| — | 95.240 | 2.01 | — | — | — | — | 62 | 58 | 58 | 59.5 | 61.5 | 58 | 58 | 58.5 | — |
| — | 95-241 | 2.10 | — | — | — | — | 62.5 | 59 | 59.5 | 60 | 62 | 58.5 | 58 | 59.5 | — |
| CPM 420VN | 95-342 | 1.95 | 13.33 | 8.86 | 1.06 | 0.458 | 62 | 58 | 58 | 59 | 61.5 | 58 | 58 | 59 | 1.87 |
| — | 95-341 | 2.10 | — | — | — | — | 63 | 59 | 59.5 | 60 | 62 | 58 | 58 | 59 | — |

*$(\% C + 6/7\% N)_{minimum} = 0.40 + 0.099 (\% Cr - 11.0) + 0.063 (\% Mo) + 0.177 (\% V)$

TABLE V

Effect of Nickel Content on the Hardness of Annealed and of Slow Cooled CPM 420V

| Bar | Chemical Composition (Wt. %) | | | | | | Annealed* Hardness | Slow Cooled** Hardness | Heat Treated*** |
|---|---|---|---|---|---|---|---|---|---|
| No. | C | Ni | Cr | V | Mo | N | (HRC) | (HRC) | Hardness (HRC) |
| 95-6 | 2.25 | 0.01 | 13.57 | 8.90 | 1.03 | 0.098 | 22 | 27 | 59.5 |
| 97-460 | 2.17 | 0.15 | 13.78 | 8.48 | 1.03 | 0.095 | 25 | 26.5 | 60 |
| 97-464 | 2.28 | 0.25 | 13.93 | 8.31 | 1.04 | 0.078 | 26 | 26.5 | 60 |
| 97-467 | 2.25 | 0.38 | 13.78 | 8.50 | 1.04 | 0.09 | 29.5 | 51.5 | 59.5 |
| 91-17 | 2.15 | 0.52 | 12.32 | 8.80 | 1.02 | 0.07 | 30 | 54 | 59.5 |
| 90-60 | 2.30 | 0.88 | 11.77 | 9.27 | 1.05 | 0.047 | 31 | 54 | 59 |
| 98-83 | 2.31 | 0.97 | 14.26 | 9.15 | 1.02 | 0.11 | 31.5 | 56.5 | 59 |

*Specimens heated at 1650° F. for 2 hours, slow cooled to 1200° F. at a rate not exceeding 25° F. per hour, and then air cooled to room temperature.
**Specimens heated at 2100° F. for 10 minutes, slow cooled to room temperature under a thermal blanket and tempered at 500° F. for 2 + 2 hours.
***Specimens heated at 2050° F. for 30 minutes, oil quenched and tempered at 500° F. for 2 + 2 hours.

TABLE VI

Charpy C-Notch Impact Properties of Experimental and Commercial Tool Steels

| Material | Bar No. | Heat No. | Chromium Content | Vanadium Content | Heat Treatment** | Hardness (HRC) | Charpy C-Notch Impact Strength (ft-lb) |
|---|---|---|---|---|---|---|---|
| D-2* | — | — | — | — | E | 61 | 17 |
| D-4* | — | — | — | — | F | 61 | 10 |
| D-7* | 75-36 | — | 12.75 | 4.43 | G | 61 | 7 |
| T440C* | — | A18017 | 16.84 | — | G | 58 | 16 |
| CPM 10V | 93-16 | P66210-2 | — | — | C | 61 | 18 |
| K190 | 90-136 | — | 12.50 | 4.60 | A | 59 | 22 |
| CPM 420V | 95-21 | P69231-2 | 13.25 | 8.53 | A | 58 | 23 |
| CPM 420V | 95-7 | L520 | 13.43 | 11.96 | A | 59 | 17 |
| CPM 420V | 95-23 | L525 | 13.31 | 14.47 | A | 58 | 11.5 |
| CPM 440V | 87-152 | P70144-1 | 16.89 | 5.34 | A | 58 | 16 |
| MPL-1 | 91-12 | P63231 | 24.21 | 9.02 | A | 63 | 6.5 |

*Conventional ingot cast material.
**Heat treatments were as follows:
A - 2050° F.130 minutes, OQ, 500° F./2 + 2 hours
B - 2150° F.110 minutes, OQ, 50° F./2 + 2 hours
C - 2050° F./30 minutes, OQ, 1025° F./2 + 2 hours
D - 21 50° F./i 0 minutes, OQ, 1000° F./2 + 2 + 2 hours
E - 1850° F./1 hour, AC, 400° F./2 + 2 hours
F - 1850° F./1 hour, OQ, 500° F./2 + 2 hours
G - 1900° F./1 hour, OQ, 400° F./2 + 2 hours
H - 210O° F./10 minutes, OQ, 50° F./2 + 2 hours
I - 1975° F./30 minutes, OQ, 500° F./2 + 2 hours Metal to Metal Wear Resistance The metal to metal wear resistance of the PM articles of the invention and of the materials tested for comparison was measured using an unlubricated crossed-cylinder wear test similar to that described in ASTM Standard G83. In this test, a cylinder of the tool steel to be tested and a cylinder made of cemented tungsten carbide containing 6% cobalt are positioned perpendicular to each other. A 15-pound load is applied to the specimens through a weight on a lever arm. During the test, the tungsten carbide cylinder is rotated at a speed of 667 revolutions per minute. As the test progresses, a wear spot forms on the specimen off the tool steel. At the end off the test, which is conducted for a fixed period off time, the extent off wear is determined by measuring the depth of the wear spot on the specimen and converting it into wear volume by aid off a relationship derived for this purpose. The metal to metal wear resistance, or the reciprocal off the wear rate, is then computed by the following formula:

$$\text{Wear Resistance} = \frac{1}{\text{Wear Rate}} = \frac{L\Delta s}{\Delta v} = \frac{L\pi d\Delta N}{\Delta v}$$

where:

v=the wear volume ($in^3$)

L=the applied load (lb)

s=the sliding distance (in)

d=the diameter off the tungsten carbide cylinder (in) and

N=the number of revolutions made by the tungsten carbide cylinder (ppm)

Figure 3:
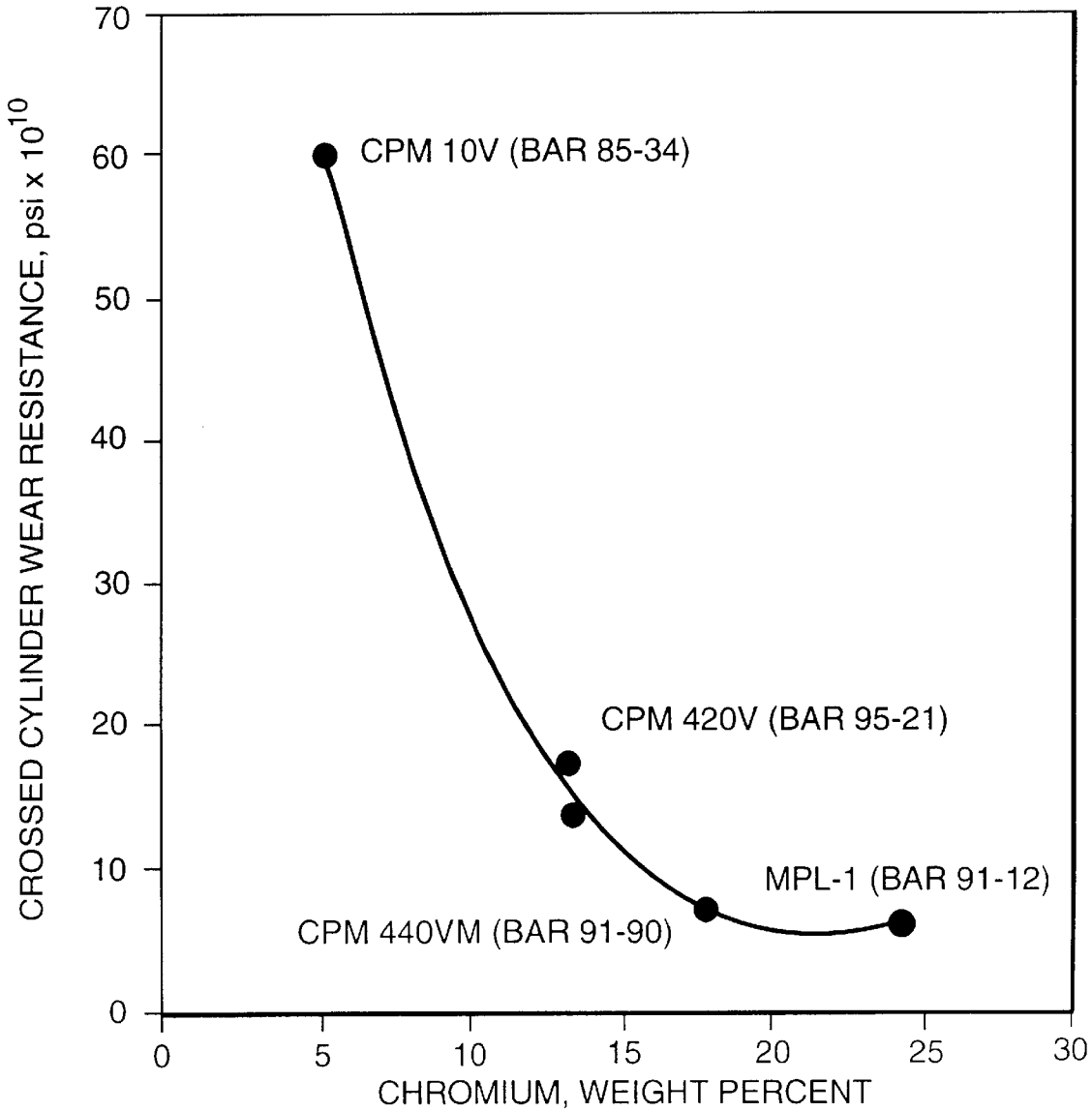
FIG. 3 is a graph showing the effect of chromium content on the metal to metal (crossed cylinder) wear resistance of PM tool steels containing about 9.0% vanadium.

The results off the metal to metal (crossed cylinder) wear tests are given in Table VII. They show that the metal to metal wear resistance off PM and conventional wear resistant materials is significantly affected by their chromniumn and vanadium contents. The highly negative effect off chromniumn on the resistance to metal to metal wear is illustrated in FIG. 3 which compares the metal to metal wear resistance of CPM 10V (Bar 85-34), CPM 420V (Bar 95-21), CPM 440VM (Bar 91-90), and MPL-1 (Bar 91-12). These materials contain roughly the same amount off vanadium but contain widely different amounts off chromnium. In contrast to previous information indicating that higher carbon and chromium contents necessarily improve wear resistance, the figure shows that increasing the chromium content of PM high vanadium, wear and corrosion-resistant tool steels substantially decreases their metal to metal wear resistance. Thus, to increase metal to metal wear resistance, the chromium content of the corrosion resistant, high vanadium martensitic PM tool steels must be limited to the minimums necessary for good corrosion resistance. For this reason, the chromium contents of the PM articles of the invention are restricted to amounts between 11.5 and 14.5%, and preferably between 12.5 and 14.5%.

Figure 4:
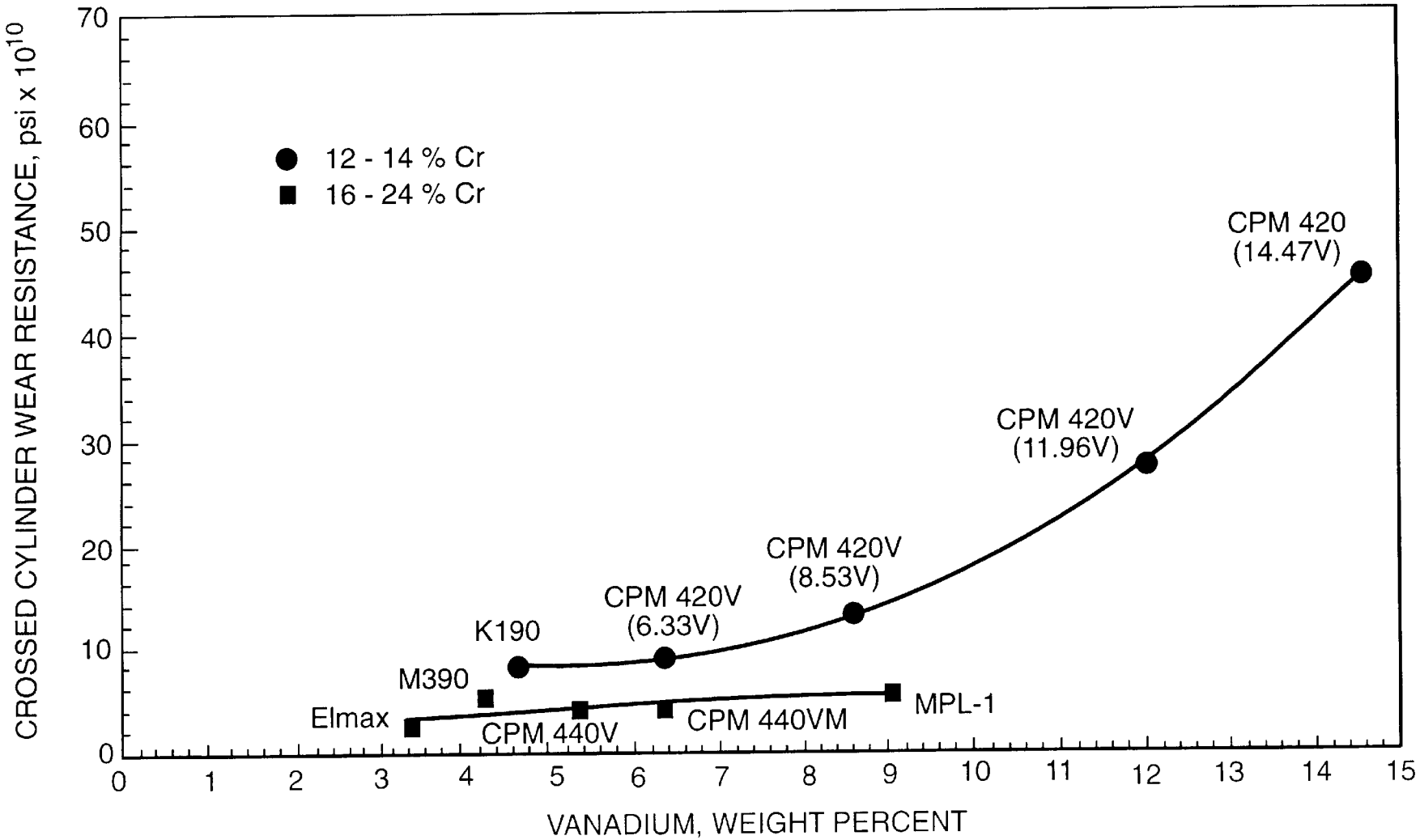
FIG. 4 is a graph showing the effect of vanadium content on the metal to metal (crossed cylinder) wear resistance of PM tool steels containing from about 12 to 14% chromium and from about 16 to 24% chromium.

FIG. 4 shows the effect of vanadium content on the metal to metal wear resistance of two groups of PM wear or wear and corrosion resistant alloys included in Table VII. One group contains from about 12 to 14% chromium and the other from about 16 to 24% chromium. For the group of PM materials containing from about 16 to 24% chromium, it is clear that increasing vanadium content from about 3 to 9% has only a small effect on metal to metal wear resistance. On the other hand, for the group of PM materials containing from about 12 to 14% chromium, increasing vanadium content above about 4%, and particularly about 8%, increases metal to metal wear resistance significantly. For a given vanadium level, it is again evident that chromium has a negative effect and that metal to metal wear resistance is higher for the group of alloys with chromium contents in the range of 12 to 14% than for the group with chromium contents in the range of 16 to 24%. For these reasons, the chromium contents of the PM articles of the invention are restricted to a range between 11.5 and 14.5% and the vanadium contents to a broad range between about 8 to about 15% and preferably within a range of about 12 to 15%.

Abrasive Wear Resistance

The abrasive wear resistance of the experimental materials was evaluated using a pin abrasion test. In this test, a small cylindrical specimen (0.25-inch diameter) is pressed against a dry, 150-mesh garnet abrasive cloth under a load of 15 pounds. The cloth is attached to a movable table which causes the specimen to move about 500 inches in a non-overlapping path over fresh abrasive. As the specimen moves over the abrasive, it is rotated around its own axis. The weight loss of the specimens was used as a measure of material performance.

The results of the pin abrasion tests are given in Table VII. For the PMV articles of the invention, it is clear that their abrasive wear resistance generally improves with vanadium content, as can be seen by comparing the weight losses for Bar 95-6 which contains 8.90% vanadium (52 to 53.7 grams) with those for Bar 95-7, which contains 11.96% vanadium (44 to 51.5 grams), and Bar 95-23 which contains 14.47% vanadium (39.5 to 47 grams). Further, it is clear that the abrasive wear resistance of the PM articles of the invention is superior to that of several commercial PM corrosion and wear resistant materials, as can be seen by comparing the weight losses for Bar 95-6 (52 to 53.7 grams) with those of Elmax (70 grams), CPM 440VM (64 grams), and M390 (60 grams).

TABLE VII

Wear Resistance of Experimental and Commercial Tool Steels

| Material | Bar No. | Heat No | C | Cr | V | Mo | N | Heat Treat.* | Hardness (HRC) | Cross Cylinder Wear Resistance (psi × $10^{10}$) | Pin Abrasion Test Wt. Loss (mg) | Comments |
|---|---|---|---|---|---|---|---|---|---|---|---|---|
| A, Experimental Materials | | | | | | | | | | | | |
| CPM420 | 89-163 | 515-656 | 1.78 | 12.63 | 6.33 | 0.21 | 0.99 | A | 58 | 9 | — | 0.20% C |
| (6V) | | | | | | | | B | — | — | — | added |
| CPM420V | 95-6 | L517 | 2.25 | 13.57 | 8.90 | 1.01 | 0.098 | A | 59.5 | — | 53.7 | — |
| (9V) | | | | | | | | B | 59 | 12.6 | 52 | |
| CPM420 | 95-21 | P69231 | 2.16 | 13.25 | 8.53 | 1.04 | 0.079 | A | 58 | 13.5 | 57.9 | — |
| (9V) | | | | | | | | B | 58.5 | 16.9 | 50.5 | |
| CPM420V | 95.7 | L520 | 2.84 | 13.43 | 11.96 | 1.02 | 0.104 | A | 60 | 27.6 | 51.5 | — |
| (12V) | | | | | | | | B | 60.5 | 33.1 | 44 | |
| CPM420V | 95-8 | L521 | 2.78 | 13.53 | 11.96 | 2.72 | 0.093 | A | 51 | 4.2 | 65 | — |
| (12V-Mo) | | | | | | | | B | 59 | 10.8 | 49 | |
| — | 95-207 | L521 + C | 2.94 | — | — | — | — | A | 60 | — | 43.3 | 0.20% C |
| | | | | | | | | B | 60 | 53.4 | 39.1 | added |
| CPM420V | 95-23 | L525 | 3.24 | 13.31 | 14.47 | 1.05 | 0.12 | A | 60 | 45.6 | 47 | — |
| (14.5V) | | | | | | | | B | 60 | 59.4 | 39.5 | |
| CPM | 95-24 | L526 | 1.91 | 13.40 | 8.94 | 0.99 | 0.32 | A | 56 | 6.0 | 62 | — |
| 420VN | | | | | | | | B | 57.5 | 19.2 | 50.4 | |
| — | 95-240 | L526 + C | 2.01 | — | — | — | — | A | 58 | 41 | 56.5 | 0.10% C |
| | | | | | | | | B | 58 | 48.6 | 48.7 | added |
| — | 95-241 | L526 + C | 2.10 | — | — | — | — | A | 59 | 38.9 | 54.5 | 0.20% C |
| | | | | | | | | B | 58.5 | — | 48.0 | added |
| CPM | 95-342 | L612 | 1.95 | 13.30 | 8.86 | 1.06 | 0.46 | A | 58 | — | 60.5 | |
| 420VN | | | | | | | | B | 58 | | 53.9 | |
| — | 95-341 | L612 + C | 2.10 | — | — | — | — | A | 59.5 | — | 59.2 | 0.15% C |
| | | | | | | | | B | 58 | | 53.0 | added |
| B, PM Materials Tested for Comparison | | | | | | | | | | | | |
| CPM10V | 85-34 | P67018 | 2.51 | 5.25 | 9.63 | 1.25 | 0.038 | C | 61 | 60 | 45 | — |
| | 93.16 | P66210-2 | 2.45 | 5.31 | 9.74 | 1.23 | 0.055 | D | 64 | 65 | 32 | |
| K190 | 90-136 | — | 2.28 | 12.50 | 4.60 | 1.11 | 0.067 | A | 59 | 8 | 46 | — |
| Elmax | 90-99 | — | 1.70 | 17.90 | 3.37 | 1.09 | 0.10 | I | 57 | 2.5 | 70 | — |
| CPM440V | 87-152 | — | 2.11 | 16.89 | 5.34 | 0.42 | 0.05 | A | 58 | 4 | — | — |
| CPM440 | 91-16 | P77326-2 | 1.89 | 17.32 | 6.34 | 1.09 | 0.06 | A | 57 | 4 | 64 | — |
| VM (9V) | | | | | | | | | | | | |
| CPM440 | 91-90 | L8 | 2.54 | 17.75 | 8.80 | 1.30 | 0.16 | A | 58.5 | 6.5 | — | — |
| VM (9V) | | | | | | | | | | | | |
| M390 | 90-100 | — | 1.89 | 19.00 | 4.23 | 1.02 | 0.11 | H | 58 | 5.1 | 60 | — |
| MPL-1 | 91-12 | P63231 | 3.74 | 24.21 | 9.02 | 3.01 | 0.079 | A | 63 | 5.5 | 30.7 | — |
| | | | | | | | | B | 64 | | | |
| C, Conventional Ingot Cast Materials | | | | | | | | | | | | |
| D2 | 75-57 | — | — | — | — | — | — | E | 60 | 1.7 | 48.6 | — |
| D-7 | 75-36 | — | 2.35 | 12.75 | 4.43 | 1.18 | 0.037 | G | 61 | — | 30.6 | — |

TABLE VII-continued

Wear Resistance of Experimental and Commercial Tool Steels

| Material | Bar No. | Heat No | C | Cr | V | Mo | N | Heat Treat.* | Hardness (HRC) | Cross Cylinder Wear Resistance (psi × $10^{10}$) | Pin Abrasion Test Wt. Loss (mg) | Comments |
|---|---|---|---|---|---|---|---|---|---|---|---|---|
| T440B | — | — | 0.89 | 18.5 | 0.10 | 0.84 | 0.04 | I | 54 | — | 78 | — |
| T440C | — | A18017 | 1.03 | 16.84 | — | 0.53 | 0.04 | G | 58 | 3 | — | — |

**Heat treatments were as follow:
A - 2050° F./30 minutes, OQ, 500° F./2 + 2 hours
B - 2150° F./10 minutes, OQ, 500° F./2 + 2 hours
C - 2050° F./30 minutes, OQ, 1025° F./2 + 2 hours
D - 2150° F./10 minutes, OQ, 1000° F./2 + 2 + 2 hours
E - 850° F./1 hour, AC, 400° F./2 + 2 hours
F - 1850° F./1 hour, OQ, 500° F./2 + 2 hours
G - 1900° F./1 hour, OQ, 400° F./2 + 2 hours
H - 2100° F./10 minutes, OQ, 500° F./2 + 2 hours
I - 1975° F./30 minutes, OQ, 500° F./2 + 2 hours Corrosion Resistance The corrosion resistance of the PM articles of the invention and of several commercial alloys that were included for comparison was evaluated in two different corrosion tests. In one test, samples were immersed for 3 hours at room temperature in an aqueous solution containing 5% nitric acid and 1% hydrochloric acid by volume. The weight losses of the samples were determined and then corrosion rates calculated using material density and specimen surface area. In the other corrosion test, samples were immersed in boiling aqueous solutions of 10% glacial acetic acid by volume for 24 hours. Each sample was immersed in the test solution. The weight loss of each sample was determined, and by using the material density and surface area, the corrosion rate was calculated and used as a measure of material performance.

TABLE VIII

Corrosion Resistance of Experimental and Commercial Tool Steels

| Material | Bar No. | Heat No. | C | Cr | V | Mo | N | Heat Treatment | Hardness HRC | Dilute Aqua-Regis 75F-3 hr. (mils/month) | Boiling 10% Acetic Acid (mils/month) | Calculated Carbon Content* Min. | Max. | Comments |
|---|---|---|---|---|---|---|---|---|---|---|---|---|---|---|
| A. Experimental Materials | | | | | | | | | | | | | | |
| CPM 420V | 95-6 | L517 | 2.25 | 13.57 | 8.90 | 1.01 | 0.098 | A | 59 | 461 | 153 | 2.21 | 2.41 | |
| | | | | | | | | B | 59.5 | 536 | 83 | | | |
| CPM 420V | 95-7 | L520 | 2.84 | 13.43 | 11.96 | 1.02 | 0.104 | A | 60 | 292 | 114 | 2.74 | 2.94 | |
| | | | | | | | | B | 60 | 323 | 58 | | | |
| CPM 420V | 95-8 | L521 | 2.76 | 13.53 | 11.96 | 2.72 | 0.093 | A | 47.5 | 110 | 41 | 2.85 | 3.05 | Low |
| | | | | | | | | B | 54 | 45 | 9 | | | Carbon |
| CPM 420V | 95-207 | L521 + C | 2.94 | | | | | A | 59 | 322 | 59 | | | 0.20% C |
| | | | | | | | | B | 61 | 376 | 80 | | | added |
| CPM 420V | 95-23 | L525 | 3.24 | 13.31 | 14.47 | 1.05 | 0.12 | A | 60 | 219 | 42 | 3.16 | 3.36 | |
| | | | | | | | | B | 60 | 218 | 19 | | | |
| CPM 420VN | 95-24 | L526 | 1.91 | 13.40 | 8.94 | 1.01 | 0.32 | A | 55 | 32 | 0 | 2.01 | 2.21 | Low |
| | | | | | | | | B | 57.5 | 19 | 0 | | | Carbon |
| | 95-240 | L526 + C | 2.01 | | | | | A | 58 | 308 | 27 | — | — | 0.10% C |
| | | | | | | | | B | 59 | 252 | 18 | | | added |
| | 95-241 | L526 + C | 2.10 | | | | | A | 59 | 483 | 109 | — | — | 0.20% C |
| | | | | | | | | B | 58.5 | 522 | 48 | | | added |
| CPM 420VN | 95-342 | L612 | 1.95 | 13.33 | 8.86 | 1.06 | 0.46 | A | 58 | 585 | 77 | 1.87 | 2.07 | |
| | | | | | | | | B | 58 | 446 | 42 | | | |
| CPM 420VN | 95-341 | L612 + C | 2.10 | | | | | A | 59.5 | 766 | 311 | — | — | 0.15% C |
| | | | | | | | | B | 56 | 798 | 137 | | | added |
| B. Commercial PM Materials Tested for Comparison | | | | | | | | | | | | | | |
| CPM10V | | | | | | | | | | | | | | |
| K190 | 90-136 | | 2.28 | 12.50 | 4.60 | 1.11 | 0.067 | A | 59 | 1046 | 640 | | | |
| Elmax | 90-99 | | 1.70 | 17.90 | 3.37 | 1.09 | 0.10 | I | 57.5 | 692 | 290 | | | |
| CPM 440V | 93-73 | P77797-1 | 2.14 | 16.98 | 5.39 | 0.40 | 0.072 | A | | 1243 | 429 | | | |
| | | | | | | | | B | | 916 | 341 | | | |
| CPM 440V | 93-48 | P66899-2 | 1.89 | 17.32 | 6.34 | 1.05 | 0.06 | A | | 1122 | 462 | | | |
| | | | | | | | | B | | 1165 | 485 | | | |
| CPM | 91-16 | P77326-2 | 1.89 | 17.32 | 6.34 | 1.09 | 0.06 | A | 56 | 362 | 17 | | | |
| 440VM | | | | | | | | B | 57 | 242 | 11 | | | |
| M390 | 90-137 | | 1.87 | 18.85 | 4.34 | 0.97 | 0.15 | C | 59 | 563 | 30 | | | |

TABLE VIII-continued

Corrosion Resistance of Experimental and Commercial Tool Steels

| Material | Bar No. | Heat No. | C | Cr | V | Mo | N | Heat Treatment | Hardness HRC | Dilute Aqua-Regis 75F-3 hr. (mils/month) | Boiling 10% Acetic Acid (mils/month) | Calculated Carbon Content* Min. | Max. | Comments |
|---|---|---|---|---|---|---|---|---|---|---|---|---|---|---|
| MPL-1 | 91-12 | P63231 | 3.74 | 24.41 | 9.02 | 3.61 | — | B | 63 | 446 | 95 | | | |
| C. Conventional Ingot Cast Materials | | | | | | | | | | | | | | |
| D-7 | | | 2.35 | 12.75 | 4.43 | 1.18 | 0.037 | | 61 | | | | | |
| T440B | | | 0.89 | 18.5 | 0.10 | 0.84 | 0.04 | I | 54 | 518 | 22 | | | |
| T440C | | A18017 | 1.03 | 16.84 | | 0.53 | 0.04 | | | | | | | |

*Heat treatments were as follows:
A - 2050° F./30 minutes, OQ, 500° F./2 + 2 hours
B - 2150° F./10 minutes, OQ, 500° F./2 + 2 hours
C - 2050° F./30 minutes, OQ, 1025° F./2 + 2 hours
D - 2150° F./10 minutes, OQ, 1000° F./2 + 2 + 2 hours
E - 1850° F./1 hour, AC, 400° F./2 + 2 hours
F - 1850° F./1 hour, OQ, 500° F./2 + 2 hours
G - 1900° F./1 hour, OQ, 400° F./2 + 2 hours
H - 2100° F./10 minutes, OQ, 500° F./2 + 2 hours
I - 1975° F./30 minutes, OQ, 500° F./2 + 2 hours The results of the corrosion tests are given in Table VIII. They show that the performance of the PM articles of the invention in the dilute aqua regia test is highly dependent on the balance between carbon and nitrogen and the amounts of chromium, molybdenum, and vanadium that they contain. PM articles represented by Bars 95-24 and 95-8 exhibit excellent corrosion resistance in this test, but as shown earlier in Tables IV and VII, their carbon and nitrogen contents are below those needed to achieve a hardness of at least 58HRC after the indicated heat treatments and to provide the desired degree of metal to metal wear resistance. Increasing carbon or nitrogen content to meet or exceed the minimum amounts needed to achieve a hardness of at least 58HRC, as with Bars 95-23, 95-7, and 95-240, slightly reduces corrosion resistance in this test, but the levels of corrosion resistance exhibited by these materials are still very high, as long as their carbon and nitrogen contents do not exceed the maximums calculated according to the following relationship:

$$(\%C+6/7\%N)_{maximum}=0.60+0.099(\%Cr-1.0)+0.063(\%Mo)+0.177(\%V)$$

The highly negative effect of exceeding the calculated limits of carbon and nitrogen can be seen by comparing the corrosion rates of Bar 95-342 (446 to 585 mils/month), whose carbon content of 1.95% does not exceed the calculated maximum value of 2.07%, with the corrosion rates of Bar 95-341 (768 to 798 mils/month) whose carbon content of 2.10% exceeds the calculated maximum value of 2.07%. The excellent performance of PM articles within the scope of the invention in relation to that of two commercial PM wear or wear and corrosion resistant alloys can be seen by comparing the corrosion rates of Bar 95-23 (218 to 219 mils/month) and Bar 95-240 (252 to 308 mils/month) with those of Bar 90-136 (1046 mils/month), which is representative of current high chromium and vanadium PM wear resistant alloys, and of Bar 93-73 (916 to 1243 mils/month), which is representative of current high chromium and vanadium PM wear and corrosion resistant alloys.

Similar to the results obtained in the dilute aqua regia tests, the results obtained in the boiling acetic acid tests also show that the corrosion resistance of the PM articles of the invention is highly dependent on their carbon and nitrogen balance. Again, Bar 95-24, which contains less than the minimum calculated carbon content, exhibits excellent corrosion resistance. However, as indicated previously, the hardness of this material is too low to provide the desired degree of metal to metal wear resistance. The corrosion resistance of PM articles within the scope of the invention is also quite good in boiling acetic acid, provided their carbon and nitrogen do not exceed the maximums calculated according to the relationship discussed above. The highly negative effect of exceeding the calculated limit of carbon can be seen by comparing the corrosion rates in acetic acid for Bar 95-342 (42 to 77 mils/month), whose carbon content of 1.95% does not exceed the calculated maximum value of 2.07%, with those for Bar 95-341 (137 to 311 mils/month) whose carbon content of 2.10% exceeds the calculated maximum value of 2.07%. The excellent performance of the PM articles of the invention in the acetic acid tests in relation to that of two PM wear or wear and corrosion resistant alloys typical of current art can be seen by comparing the corrosion rates of Bars 95-23 (19 to 42 mils/month) and 95-240 (18 to 27 mils/month) with those of Bars 90-136 (640 mils/month) and 93-73 (341 to 429 mils/month).

The beneficial effect of substituting nitrogen for part of the carbon on the corrosion resistance of the PM articles of the invention can be seen by comparing the corrosion rates of Bars 95-240, 95-241, and 95-6 in the acetic acid tests. These bars contain roughly the same amounts of chromium, molybdenum, and vanadium, but have significantly different carbon and nitrogen contents. As can be seen in Table VIII, Bar 95-240, which contains 2.01% carbon and 0.32% nitrogen, has the lowest corrosion rates (18–27 mils/month) followed in order by Bar 95-241 (48 to 109 mils/month), which contains 2.10% carbon and 0.32% nitrogen, and by Bar 95-6 (83 to 153 mils/month), which contains 2.25% carbon and 0.098% nitrogen.

In summary, the results of the wear and corrosion tests show that the high vanadium PM articles of the invention exhibit a notably improved combination of metal to metal, abrasive, and corrosive wear resistance that is unmatched by corrosion and wear resistant tool steels of current design. The improved properties of these PM articles are based on the discovery that the metal to metal wear resistance of corrosion resistant, high vanadium PM tool steels is markedly reduced by chromium content and that for best metal to metal wear resistance their chromium contents must be reduced to the minimum levels necessary for good corrosion resistance. Further, to achieve good corrosion resistance at these lower chromium levels, and to obtain the hardness needed for good metal to metal and abrasive wear resistance, it is essential that the carbon and nitrogen contents of the PM articles of the invention be closely balanced with the chromium, molybdenum, and vanadium contents of the articles according to the indicated relationships. Carbon and nitrogen levels below the calculated minimums slightly improve corrosion resistance, but do not provide sufficient hardness and wear resistance. Carbon and nitrogen levels above the calculated maximums increase attainable hardness, but have a highly detrimental effect on corrosion resistance. Further, nitrogen has been found to improve the corrosion resistance of the PM articles of the invention and can be substituted for part of the carbon in these articles when corrosion resistance is of primary importance.

Further, nickel has been found to have an unusually strong effect on the hardenability of the PM articles of the invention. Nickel, in amounts ranging from about 0.30 to 1.80% can be beneficially used to increase the hardenability of these articles when low annealed hardnesses are not essential.

The properties of the PM articles of the invention make them particularly useful in monolithic tooling or in hot isostatically pressed (HIP) or mechanically clad composites used in the production of reinforced plastics, such as in alloy steel clad barrels, barrel liners, screw elements, and nonreturn valves. Other potential applications include corrosion resistant bearings, knives, and scrapers used in food processing, and corrosion resistant dies and molds.

The term $M_7C_3$ carbide as used herein refers to chromium-rich carbides characterized by hexagonal crystal structure wherein "M" represents the carbide forming element chromium and smaller amounts of other elements such as vanadium, molybdenum, and iron that may also be in the carbide. The term also includes variations thereof known as carbonitrides wherein some of the carbon is replaced by nitrogen.

The term MC carbide as used herein refers to vanadium-rich carbides characterized by a cubic crystal structure wherein "M" represents the carbide forming element vanadium, and small amounts of other elements such as molybdenum, chromium, and iron that may also be present in the carbide. The term also includes the vanadium-rich $M_4C_3$ carbide and variations known as carbonitrides wherein some of the carbon is replaced by nitrogen.

All percentages are in weight percent, unless otherwise indicated.

What is claimed is:

1. A fully dense, corrosion resistant, high vanadium, powder metallurgy cold work tool steel article with high metal to metal wear resistance made from nitrogen atomized prealloyed powders, consisting essentially of, in weight percent, 1.47 to 3.77 carbon, 0.2 to 2.0 manganese, up to 0.10 phosphorus, up to 0.10 sulfur, up to 2.0 silicon, 0.3 to 1.80 nickel, 11.5 to 14.5 chromium, up to 3.00 molybdenum, 8.0 to 15.0 vanadium, 0.03 to 0.46 nitrogen, and balance iron and incidental impurities; wherein carbon and nitrogen are balanced according to the formulas:

$$(\%C+6/7\%N)_{minimum}=0.40+0.099(\%Cr-11.0)+0.063(\%Mo)+0.177(\%V);$$

$$(\%C+6/7\%N)_{maximum}=0.60+0.099(\%Cr-11.0)+0.063(\%Mo)+0.177(\%V);$$

said articles when hardened and tempered to a hardness of at least 58HRC having a volume fraction of primary $M_7C_3$ and MC carbides between 16 and 36% in which the volume of MC carbide is at least one third of the total primary carbide volume and where the maximum sizes of the primary carbides do not exceed about six microns in their largest dimension, and wherein, as defined herein, a metal to metal wear resistance of at least $10\times10^{10}$ psi is achieved.

2. A fully dense, corrosion resistant high vanadium, powder metallurgy cold work tool steel article made from nitrogen atomized prealloyed powders, consisting essentially of, in weight percent, 1.83 to 3.77 carbon, 0.2 to 1.0 manganese, up to 0.05 phosphorus, up to 0.03 sulfur, 0.2 to 1.00 silicon, 0.30 to 1.80 nickel, 12.5 to 14.5 chromium, 0.5 to 3.00 molybdenum, 8.0 to 15.0 vanadium, 0.03 to 0.19 nitrogen, and balance iron with incidental impurities, wherein carbon and nitrogen are balanced according to the formulas:

$$(\%C+6/7\%N)_{minimum}=0.40+0.099(\%Cr-11.0)+0.063(\%Mo)+0.177(\%V);$$

$$(\%C+6/7\%N)_{maximum}=0.60+0.099(\%Cr-11.0)+0.063(\%Mo)+0.177(\%V);$$

said articles when hardened and tempered to a hardness of at least 58HRC having a volume fraction of primary $M_7C_3$ and MC carbides between 16 and 36% in which the volume of MC carbide is at least one third of the total carbide volume and where the maximum sizes of the primary carbides do not exceed about six microns in their largest dimension and wherein, as defined herein, a metal to metal wear resistance of at least $10\times10^{10}$ psi is achieved.

3. A fully dense, corrosion resistant high vanadium powder metallurgy cold work tool steel article made from nitrogen atomized prealloyed powders, containing, in weight percent, 1.60 to 3.62 carbon, 0.2 to 1.0 manganese, up to 0.05 phosphorus, up to 0.03 sulfur, 0.2 to 1.00 silicon, 0.30 to 1.80 nickel, 12.5 to 14.5 chromium, 0.5 to 3.00 molybdenum, 8.0 to 15.0 vanadium, 0.20 to 0.46 nitrogen, and balance iron with incidental impurities, wherein carbon and nitrogen are balanced according to the formulas:

$$(\%C+6/7\%N)_{minimum}=0.40+0.099(\%Cr-11.0)+0.063(\%Mo)+0.177(\%V);$$

$$(\%C+6/7\%N)_{maximum}=0.60+0.099(\%Cr-11.0)+0.063(\%Mo)+0.177(\%V);$$

said articles when hardened and tempered to a hardness of at least 58HRC having a volume fraction of primary $M_7C_3$ and MC carbides between 16 and 36% in which the volume of MC carbide is at least one third of the total carbide volume and where the maximum sizes of the primary carbides do not exceed about six microns in their largest dimension and wherein, as defined herein, a metal to metal wear resistance of at least $10\times10^{10}$ psi is achieved.

4. The article of claim 2, wherein the vanadium content is within the range of 12.0 to 15.0 weight percent and carbon is within the range of 2.54 to 3.77 weight percent.

5. The article of claim 3, wherein the vanadium content is within the range of 12.0 to 15.0 weight percent and carbon is within the range of 2.31 to 3.62 weight percent.

6. The article of claim 1, 2, 3, 4, or 5, wherein nickel is within the range of 0.30 to 0.60%.

7. The article of claim 1, 2, 3, 4, or 5, wherein nickel is within the range of 0.30 to 1.00%.

8. A method for producing a fully dense, corrosion resistant, powder metallurgy cold work tool steel article with high metal to metal wear resistance, said method consisting of nitrogen atomizing a molten tool steel alloy consisting essentially of, in weight percent, 1.47 to 3.77 carbon, 0.2 to 2.0 manganese, up to 0.10 phosphorus, up to 0.10 sulfur, up to 2.0 silicon, 0.30 to 1.80 nickel, 11.5 to 14.5 chromium, up to 3.00 molybdenum, 8.0 to 15.0 vanadium, 0.03 to 0.46 nitrogen, and balance iron and incidental impurities; wherein carbon and nitrogen are balanced according to the formulas:

$$(\%C+6/7\%N)_{minimum}=0.40+0.099(\%Cr-11.0)+0.063(\%Mo)+0.177(\%V);$$

$$(\%C+6/7\%N)_{maximum}=0.60+0.099(\%Cr-11.0)+0.063(\%Mo)+0.177(\%V);$$

at a temperature between 2800 and 3000° F. to produce powder, rapidly cooling the powder to ambient temperature, screening the powder to about −16 mesh (U.S. standard), hot isostatically compacting the powder at a temperature of 2000 to 2100° F. at a pressure of 13 to 16 ksi, hot working, annealing, and hardening the resulting article to at least 58HRC said resulting article having a volume fraction of primary $M_7C_3$ and MC carbides between 16 and 36% in which the volume of MC carbides is at least one third of the primary carbide volume and where the maximum sizes of the primary carbides do not exceed about six microns in their largest dimension, and wherein, as defined herein, a metal to metal wear resistance of at least $10\times10^{10}$ psi is achieved.

9. The method of claim 8, wherein said powder metallurgical tool steel article consists essentially of, in weight percent, 1.47 to 3.77 carbon, 0.2 to 2.0 manganese, up to 0.10 phosphorus, up to 0.10 sulfur, up to 2.0 silicon, 0.30 to 1.80 nickel, 11.5 to 14.5 chromium, up to 3.00 molybdenum, 8.0 to 15.0 vanadium, 0.03 to 0.46 nitrogen, and balance iron and incidental impurities, wherein carbon and nitrogen are balanced according to the formulas:

$$(\%C+6/7\%N)_{minimum}=0.40+0.099(\%Cr-11.0)+0.063(\%Mo)+0.177(\%V);$$

$$(\%C+6/7\%N)_{maximum}=0.60+0.099(\%Cr-11.0)+0.063(\%Mo)+0.177(\%V).$$

10. The method of claim 8, wherein said powder metallurgical tool steel article consists essentially of, in weight percent, 1.83 to 3.77 carbon, 0.2 to 1.0 manganese, up to 0.05 phosphorus, up to 0.03 sulfur, 0.2 to 1.00 silicon, 0.30 to 1.80 nickel, 12.5 to 14.5 chromium, 0.5 to 3.00 molybdenum, 8.0 to 15.0 vanadium, 0.03 to 0.19 nitrogen, and balance iron with incidental impurities, wherein carbon and nitrogen are balanced according to the formulas:

$$(\%C+6/7\%N)_{minimum}=0.40+0.099(\%Cr-11.0)+0.063(\%Mo)+0.177(\%V);$$

$$(\%C+6/7\%N)_{maximum}=0.60+0.099(\%Cr-11.0)+0.063(\%Mo)+0.177(\%V).$$

11. The method of claim 8, wherein said powder metallurgical tool steel article consists essentially of, in weight percent, 1.60 to 3.62 carbon, 0.2 to 1.0 manganese, up to 0.05 phosphorus, up to 0.03 sulfur, 0.2 to 1.0 silicon, 0.30 to 1.80 nickel, 12.5 to 14.5 chromium, 0.5 to 3.00 molybdenum, 8.0 to 15.0 vanadium, 0.20 to 0.46 nitrogen, and balance iron with incidental properties, wherein carbon and nitrogen are balanced according to the formulas:

$$(\%C+6/7\%N)_{minimum}=0.40+0.099(\%Cr-11.0)+0.063(\%Mo)+0.177(\%V);$$

$$(\%C+6/7\%N)_{maximum}=0.60+0.099(\%Cr-11.0)+0.063(\%Mo)+0.177(\%V).$$

12. The method of claim 10, wherein the vanadium content of the powder metallurgical article is between 12.0 and 15.0 weight percent and carbon is within the range of 2.54 to 3.77 weight percent.

13. The method of claim 11, wherein the vanadium content of the powder metallurgical article is within the range of 12.0 to 15.0 weight percent and carbon is within the range of 2.31 to 3.62 weight percent.

14. The method of claim 8, wherein said nitrogen atomizing is at a temperature between 2840 and 2880° F. and compacting at a temperature of about 2065° F. at a pressure of 15 ksi.

15. The method of claim 8, 9, 10, 11, 12, 13, or 14, wherein nickel is within the range of 0.30 to 0.60%.

16. The method of claim 8, 9, 10, 11, 12, 13, or 14, wherein nickel is within the range of 0.30 to 1.00%.

* * * * *